United States Patent [19]

Ramer

[11] 4,116,123

[45] Sep. 26, 1978

[54] COMPACTING APPARATUS

[75] Inventor: Mervin Ramer, Cushing, Okla.

[73] Assignee: Lawrence Murray, Perkins, Okla.

[21] Appl. No.: 782,493

[22] Filed: Mar. 29, 1977

[51] Int. Cl.[2] ..... B30B 9/32

[52] U.S. Cl. ..... 100/233; 100/DIG. 1; 100/281; 100/295; 83/923

[58] Field of Search ..... 100/233, 272, DIG. 1, 100/281, 295; 38/36, 40, 41; 83/923, 535, 536, 531, 541, 597, 599, 604

[56] References Cited

U.S. PATENT DOCUMENTS

| | | | |
|---|---|---|---|
| 2,171,235 | 8/1939 | Gates | 100/233 |
| 3,273,493 | 9/1966 | Smiltneek | 100/233 |
| 3,730,078 | 5/1973 | Flanagan | 100/233 |
| 3,796,151 | 3/1974 | Williams | 100/233 |

*Primary Examiner*—Billy J. Wilhite
*Attorney, Agent, or Firm*—Dunlap, Codding & McCarthy

[57] ABSTRACT

A scrap metal compacting apparatus wherein scrap is compressed between a lower jaw formed on the base of the machine and an upper jaw formed on a lid pivotally mounted on the base. A lever arm connects the lid to a trolley which is moved along longitudinally rails disposed in a channel formed in the base to pivot the upper jaw away from the lower jaw and to pivot the upper jaw toward the lower jaw.

13 Claims, 9 Drawing Figures

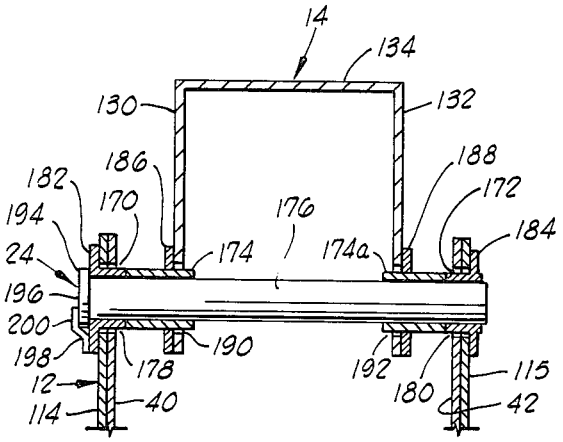
FIG. 3
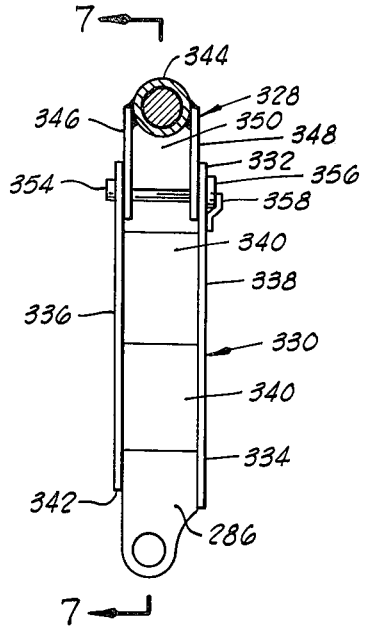
FIG. 5
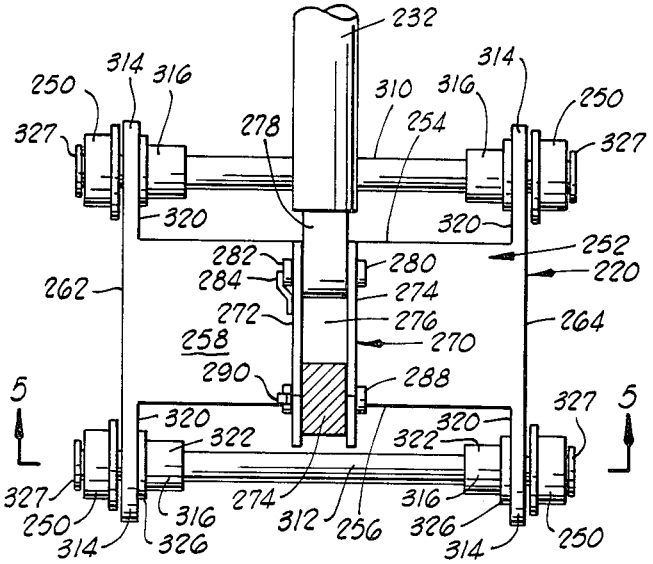
FIG. 4
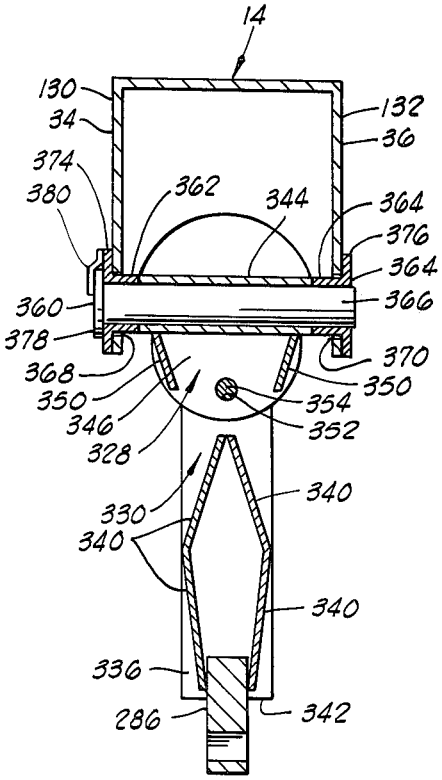
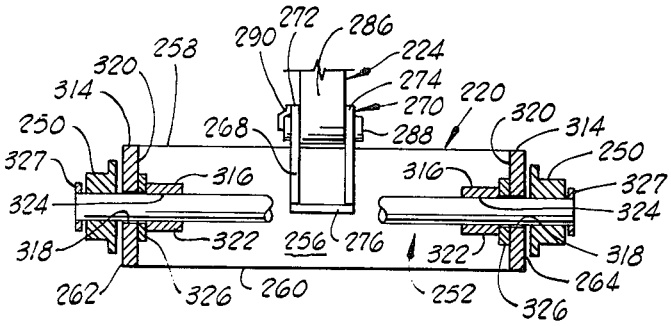
FIG. 6
FIG. 7

COMPACTING APPARATUS

BACKGROUND OF THE INVENTION

1. Field of the Invention

This invention relates to scrap metal compacting machines and, in particular but not by way of limitation, to machines used for crushing scrap automobiles.

2. Brief Description of the Prior Art

In the twentieth century the American people have become a nation on wheels; it is not uncommon for a family to own two or even three or four automobiles. To supply the demand for automobiles in the U.S., millions of automobiles are manufactured domestically each year and many more are imported from abroad.

Although, with proper care, an automobile may provide years of service to its owner or, as is often the case, to a succession of owners, eventually its useful life as a means of transportation comes to an end, with the result that a large number of automobiles are removed from such service each year. The value of the automobile, however, does not terminate with the end of its use as a moving vehicle. These automobiles form a valuable resource consisting of many tons of scrap steel which are annually available for reprocessing into new commodities.

Clearly, any factor which increases the cost of handling these automobiles reduces their value as a source of steel and, accordingly, reduces the price a scrap dealer can obtain for them. Excessive bulk is such a factor. For example, since the capacity of a carrier, such as a railway car, is limited to the bulk it can accommodate, excessive bulk increases transport costs by reducing the effective weight carrying capacity of the transport means. For this reason, scrap automobiles, which occupy a much larger volume than that of the steel of which they are made, are commonly compacted prior to shipment to a steel mill.

Machines for compacting scrap automobiles are well known in the art. A basic design for these machines is a fixed base and one or more pressing members which are moved to allow an automobile to be placed on the base and subsequently moved down on the automobile to crush it against the base. An example of such a machine is disclosed in U.S. Pat. No. 3,370,078, granted May 1, 1973 to Robert L. Flanagan. In this machine a bin is formed in the base, and a pressing member, a lid, is pivotally mounted on a wall of the bin. A hydraulic ram mounted on the lid raises the lid out of the bin so that an automobile may be placed therein. The hydraulic ram then brings the lid down upon the automobile to crush it.

A problem associated with machines used for this purpose is that the resistance of the automobile to compaction increases near the end of the compaction process. During the initial portion of the process, sheet metal forming an open shell is crumpled so that relatively small forces are required during this part of the process. Near the end of the process, however, the various portions of the automobile being compacted contact and support each other and are supported by the automobile frame so that the crushing force must be increased.

If, as is often the case, the machine uses a hydraulic ram to drive the pressing member, the ram must be capable of providing the large forces required during the final portion of the process. As a result, the full capabilities of the ram may not be utilized during the initial part of the process. Ideally, the machine should be designed such that the full capability of the ram is used during the entire process with this capability being utilized, during the initial portion of the process, to move the pressing member at relatively high speed and, during the final portion of the process, to move the pressing member at a lower speed but with a correspondingly greater force.

Another problem with machines of this type is that the crushed automobile tends to buckle outward during the compaction process. Although this buckling may be prevented by providing the machine with walls, so that the crushing occurs within a chamber, such a solution is not desirable because of the limitations it places on access to the region in which the automobile is crushed.

SUMMARY OF THE INVENTION

According to the present invention, a scrap metal compacting apparatus is constructed to comprise a base against which the scrap is crushed by a lid pivotally mounted on the base and driven by a hydraulic ram. In order to more fully utilize the capabilities of the ram, the lid is driven via a toggle linkage comprising a reciprocating member which moves back and forth in the base and a lever arm which connects the reciprocating member with the lid. This linkage introduces a variable mechanical advantage into the machine so that the lid moves at high speed during the initial portion of the compaction process and moves at low speed, with relatively greater force, during the final portion of the process.

In order to confine the object to be crushed between the base and lid during the compaction process without limiting access to the object when the lid is lifted from the object, the lid is provided with a plurality of teeth, located along the sides of the lid, which are brought down around the object during compaction and which are lifted out of the way when the lid is lifted. The teeth are provided with guidewings to guide outwardly buckled portions toward the region between the jaws.

An object of this invention is to provide an apparatus for compacting scrap metal and which is characterized as having maximum mechanical advantage at all times during operation thereof.

Another object of the invention is to provide such a compacting apparatus which moves a crushing member at a relatively high speed when relatively small forces are required in the crushing process and which enables the crushing member to exert large forces when large forces are required.

A further object of the invention is to provide the crushing member with a plurality of teeth to confine the object to be crushed during compaction and to provide relatively free access to the object after compaction.

Other objects and advantages of the invention will be evident from the following detailed description when read in conjunction with the accompanying drawings which illustrate an embodiment of the invention, and when read in conjunction with the appended claims.

BRIEF DESCRIPTION OF THE DRAWINGS

FIG. 3 is a partial sectional view of the compacting apparatus taken substantially along line 3—3 of FIG. 1.

FIG. 4 is a top plan view of the trolley of the toggle linkage of the compacting apparatus of FIG. 2.

FIG. 5 is an elevational view in partial section of one end of the trolley shown in FIG. 4.

FIG. 6 is a side elevational view of the lever arm of the toggle linkage of the compacting apparatus shown in FIG. 1.

FIG. 7 is a sectional view of the lever arm taken substantially along line 7—7 of FIG. 6. Portions of the lid, in section, have been included in FIG. 7 to illustrate the attachment of the lever arm to the lid.

DESCRIPTION OF THE COMPACTING APPARATUS

Figure 1:
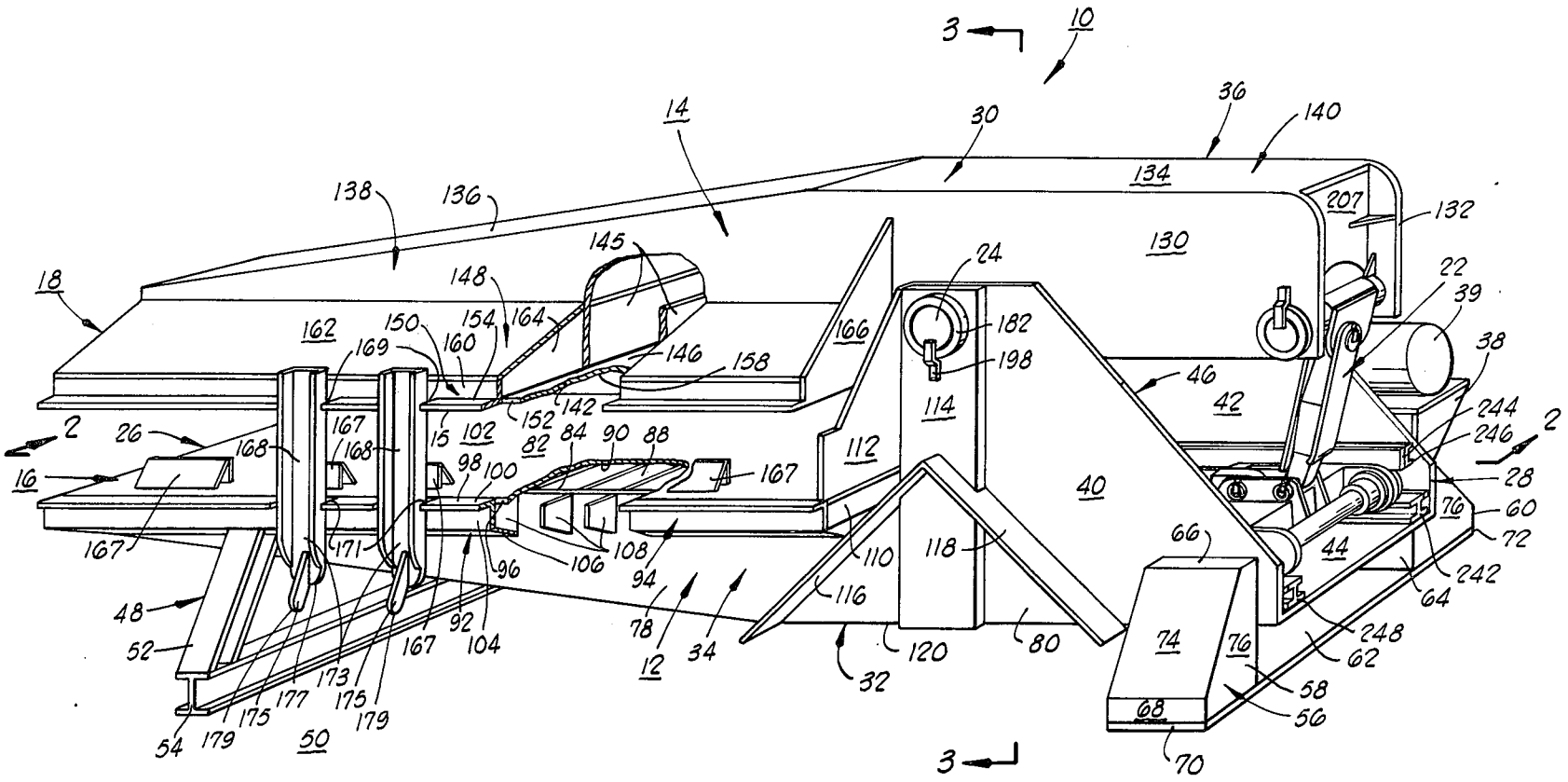
FIG. 1 shows a semi-detailed perspective view of the compacting apparatus, in partial cut-away, constructed in accordance with the present invention.

Referring now to the drawings and to FIG. 1 in particular, shown therein and designated by the general reference number 10 is a compacting apparatus, also referred to herein as a car crusher, constructed in accordance with the present invention. The car crusher 10 generally includes a base 12 and a lid member 14 that is pivotally mounted on the base 12 of a forward portion of the base 12 forms a lower jaw 16 and a forward portion of the lid 14 forms an upper jaw 18.

A hydraulically actuated toggle linkage 22 is provided to rotate the lid 14 about a pivot 24 to place the lid 14 alternatively in a closed position (illustrated in FIG. 1), in which the upper jaw 18 substantially overlays the lower jaw 16 and is spaced a preselected distance therefrom, and in an open position (not illustrated) in which the upper jaw 18 is disposed at a large angle to the lower jaw 16, providing unobstructed access to the lower jaw 16. An object to be crushed, for example an automobile, is placed on the lower jaw 16 while the upper jaw 18 is disposed in the open position. The object is crushed when the toggle linkage 22 is actuated to place the upper jaw 18 in the closed position, thereby crushing the object between the lower jaw 16 and the upper jaw 18. The cycle may be repeated by actuating the toggle linkage 22 to return the upper jaw 18 to the open position, removing the crushed object, placing another object to be crushed on the lower jaw 16, and again actuating the toggle linkage 22 to move the upper jaw 18 into the closed position.

It will be readily apparent to one skilled in the art that large forces must be exerted on an automobile or the like in order to crush it in preparation for shipment to a steel mill for salvage. To provide a structure capable of exerting these forces, the base 12 and the lid 14 are constructed throughout of heavy gage steel plate. In one preferred embodiment, five-eighths (⅝) inch thick steel plate is used extensively in the construction of the car crusher 10, and a system of internal and external bracing is employed to form the car crusher 10 into a strong, rigid structure.

It will also be recognized that the resistance of an automobile or the like to crushing will increase as the automobile becomes compacted. In order to provide greater forces on the automobile near the end of the crushing period, the toggle linkage 22 is constructed, as will be described more fully below, in such a manner that it provides the car crusher 10 with a variable mechanical advantage, the mechanical advantage increasing as the upper jaw 18 approaches the closed position.

As illustrated in FIG. 1, the car crusher 10 has a forward end 26, a rear end 28, an upper side 30, and an under side 32. The jaws 16 and 18 are disposed generally near the forward end 26 of the car crusher and the toggle linkage 22 is disposed generally near the rear end 28 of the car crusher 10. The pivot 24 is disposed intermediate to the forward portion and the rear portions of the lid member 14. The car crusher 10 possesses a high degree of bilateral symmetry and has a first side 34 and a second side 36, the second side 36 being substantially the mirror image of the first side 34. The bilateral symmetry is disrupted in noncritical details; in particular, the car crusher 10 incorporates a number of pivots which, for convenience of manufacture, are constructed assymmetrically. Moreover, the car crusher is actuated hydraulically and, for convenience, a shelf 38 is constructed on the second side 36 of the base 12 to provide a convenient mount for a hydraulic pump and motor system 39.

Because of the bilateral symmetry, it will not be necessary to describe the detailed construction of parts of the car crusher 10 disposed on the second side 36 thereof which are identical in construction to corresponding parts disposed on the first side 34 of the car crusher 10. Rather, it will be sufficient for purposes of this disclosure to merely state that a part disposed on the second side 36 is the mirror image of a part disposed on the first side 34 and give such parts similar names and, where appropriate, identical numerical designations.

The base 12 includes a first sidewall 40 disposed generally on the first side 34 of the car crusher 10 and a second sidewall 42, constructed as the mirror image of the first side-wall 40 and disposed generally on the second side 36 of the car crusher 10. A floor plate 44, disposed along the under side 32 of the car crusher 10 connects the second sidewall 42 to the first sidewall 40 in such a manner that the second sidewall 42 is spaced a distance from the first sidewall 40 and is substantially parallel thereto. Thus, the base 12 has a generally U-shaped channel 46 extending from the rear end 28 of the car crusher 10 toward the forward end 26 thereof. As will be described more fully below, the toggle linkage 22 is disposed generally within the channel 46 and is moved therealong to alternately place the upper jaw 18 in the open position and in the closed position.

The forward end 26 of the car crusher 10 is supported by a forward support 48 which is attached to the sidewalls 40, 42 near the forward end 26 of the car crusher 10 and extends generally downwardly therefrom to engage a support surface 50. The forward support 48 includes a first leg 52, constructed of a length of I-beam, which is welded to the first sidewall 40 and extends therefrom on a downward incline terminating at a forward support base 54 which is also constructed of a length of I-beam and which contactingly engages the support surface 50. A second leg 53 (shown in FIG. 2), which is the mirror image of the first leg 52, is similarly attached to the second sidewall 42 and extends therefrom on a downward incline terminating at the forward support base 54. The terminal ends of the first leg 52 and the second leg 53 are welded to the forward support base 54 to complete the construction of the forward support 48.

The rear end 28 of the car crusher 10 is supported by a rear support 56 which is attached to the sidewalls 40, 42 and extends generally downwardly therefrom to engage the support surface 50. The rear support 56 generally includes a first leg 58 attached to the first sidewall 40 and a second leg 60 attached to the second sidewall 42. The first and second legs, 58 and 60 respectively, are box structures formed on and connected to a base plate 62 which engages the earth's surface 50 to provide support for the rear end 28 of the car crusher 10. The legs 58, 60 are constructed of a plurality of plates, interconnected by welding, and the construction of the second leg 60 mirrors the construction of the first leg 58 so that it will suffice for this disclosure to describe the legs 58, 60 together and use identical numbers for corresponding parts thereof.

The legs 58, 60 include inner plates 64, (the inner plate of the first leg 58 is not visible in FIG. 1 so attention is directed to the second leg 60 for which the inner plate 64 is shown) which engage and are welded to the sidewalls 40, 42, extending therealong and beyond the floor plate 44, and terminating at the base plate 62 to which the inner plates 64 are welded. Upper plate members 66 are welded to sidewalls 40, 42 and to the inner plates 64, the upper plate members 66 extending generally perpendicularly to the side walls 40, 42 so that the upper plate members are substantially parallel to the base plate 62. Outer plate members 68 are welded to outer ends 70, 72 of the base plate 62 and extend substantially perpendicular thereto so that the outer plate members 68 are substantially parallel to the sidewalls 40, 42. Wall plate members 74 are welded to the distal end of each upper plate member 66 and extend therefrom along a downward incline to the distal end of the corresponding outer plate member 68, to which the wall plate members 74 are welded, so that the plates 62, 64, 66, 68, and 74 form the sides of the legs 58, 60 such that the legs are substantially triangular, box-like structures. One end of each leg 58, 60, is closed, generally adjacent the rear end 28 of the car crusher 10, by an end plate 76 and the other end of each leg is closed by similar end plate (not shown).

Figure 2:
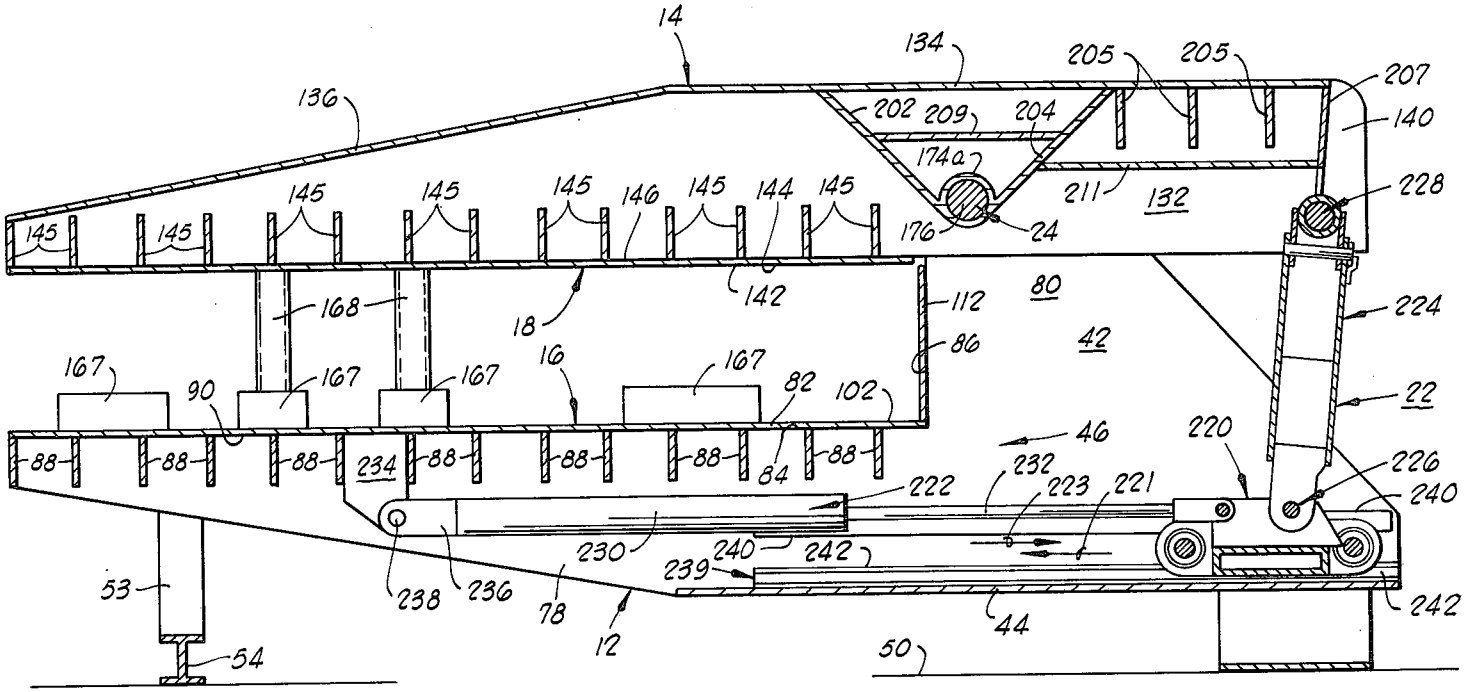
FIG. 2 is a sectional view of the compacting apparatus taken substantially along line 2—2 of FIG. 1.

In order to more particularly point out the structure of the jaws 16, 18, the drawing of the car crusher 10 in FIG. 1 has been partially cut away and FIG. 2 has been provided to illustrate the interior of the U-shaped channel 46. As seen in these drawings, and in FIG. 2 in particular, the sidewalls 40, 42 each comprise a forward section 78, upon which the lower jaw 16 is constructed, and a rear section 80 upon which the lid 14 is pivotally mounted. The rear section 80 has a greater vertical extent than the forward section 78 so that the upper jaw 18, constructed on the lid 14, will be disposed a distance above the lower jaw 16 and generally parallel thereto when the upper jaw 18 is pivoted into the closed position.

The lower jaw 16 generally comprises a platform 82 which is welded to the upper edges 84 of the forward portions 78 of the sidewalls 40, 42 and extends therealong from the forward end 26 of the car crusher 10 to the forward edge 86 of the rear portion of the sidewalls 40, 42. The lower jaw 16 further comprises a plurality of braces 88 which are welded to the side walls 40, 42 and to the lower surface 90 of the platform 82. The braces 88, which extend transversely across the channel 46, serve to strengthen the lower jaw 16 and to contribute to support the platform 82 in a generally horizontal position on the forward sections 78 of the side walls 40, 42.

As more clearly shown in FIG. 1, the platform 82 extends away from the first sidewall 40 on the first side 34 of the car crusher 10 so that the lower jaw 16 includes a first base sidewing 92 on the first side 34. The first base sidewing 92 includes an angle member 94 which is welded to the outer edge 96 of the platform 82, extending along the length thereof. A first web 98 of the angle member 94 forms a sideward extension of the platform 82, the upper surface 100 of the web 98 being disposed flush with the upper surface 102 of the platform 82, and a second web 104 extends downwardly from the outer edge 96 of the platform 82 to form an outer wall for the first base sidewing 92. An underside plate 106 is welded to the distal edge of the second web 104 and extends therefrom to the first sidewall 40 so that the first base sidewing 92 is a tubular structure having walls formed by the first sidewall 40, the platform 82, the second web 104 of the angle member 94, and the underside plate 106. The first base sidewing 92 is strengthened by a plurality of internal gussets 108 disposed transversely thereto and welded to the first sidewall 40, the platform 82 and the second web 104. One member (not shown) of the plurality of gussets 108 closes the first base sidewing 92 at the forward end 26 of the car crusher 10 and a cover plate 110 closes the first sidewing 92 near the junction of the forward section 78 and the rear section 80 of the first sidewall 40.

A second base sidewing (not shown) is formed on the second side 36 of the car crusher 10 and cooperates with the first base sidewing 92 to provide the lower jaw 16 with the width necessary to accommodate an automobile on the platform 82. The second base sidewing mirrors the first base sidewing 92 both in construction and in location on the base 12 so that it is not necessary for purposes of this disclosure to describe the second base sidewing.

As will be clear to one skilled in the art, the pivotation of the lid 14 about the pivot 24 formed on the sidewalls 40, 42 results in large forces being exerted on the rear sections 80 of the sidewalls 40, 42, such forces arising from the weight of the lid 14 and from the use of the pivot 24 as a fulcrum about which the lid 14 is turned. The rear sections 80 of the sidewalls 40, 42 are provided with a system of bracing to enable them to withstand these forces. Since, during operation of the car crusher 10, the toggle linkage 22 and portions of the lid 14 move within the channel 46 between the rear sections 80 of the sidewalls 40, 42, the system of bracing so provided is disposed externally to the channel 46 rather than internally thereto.

The external bracing includes a bulkhead 112 which braces the rear sections 80 of the sidewalls 40, 42 against the lower jaw 16; thereby preventing flexing of the rear sections 80 during operation of the car crusher 10. The bulkhead 112 is positioned transversely to and in engagement with the sidewalls 40, 42, along the forward edges 86 of the rear sections 80 thereof (see FIG. 2), and transversely to and in engagement with the upper surface 102 of the platform 82, the bulkhead 112 extending beyond the first sidewall 40 to engage the first base sidewing 92 and extending beyond the second side wall 42 to engage the second base sidewing (not shown). The bulkhead 112 is welded to the side walls 40, 42 and to the platform 82 so that the bulkhead 112 braces the rear sections 80 against the first base sidewing 92 on the first side 34 of the car crusher 10 and against the second base sidewing (not shown) on the second side 36 thereof.

To provide additional support for the pivot 24 on the first side 34 of the car crusher 10, a vertical brace plate 114 is welded to the first sidewall 40, the vertical brace plate 114 extending along the vertical dimension of the first sidewall 40 and intersecting the pivot 24. Intersecting diagonal braces 116, 118, welded to each other along their line of intersection, to the vertical brace plate 112 and to the first sidewall 40, are mounted substantially perpendicularly to the first sidewall 40 and extend along downward inclines from their intersection near the midpoint of the vertical brace plate 114 to the lower edge 120 of the first sidewall 40; thereby completing the external bracing on the first sidewall 40. The second sidewall 42 is provided with an identical vertical brace plate 115 (shown in FIG. 3) and identical diagonal braces (not shown) to provide additional support for the pivot 24 on the second side 36 of the car crusher 10.

The construction of the lid 14 is generally similar to the construction of the base 12; in particular, the lid 14 is substantially a bilaterally symmetric structure, the symmetry being disrupted only in minor, non-critical details, and is constructed of heavy gage steel plate. The lid 14 includes a first side plate 130, disposed generally on the first side 34 of the car crusher 10, and a second side plate 132, identical in construction to the first side plate 130 and disposed generally on the second side 36 of the car crusher 10. A rear ceiling plate 134 and a forward ceiling plate 136, both of which are disposed generally along the upper side 30 of the car crusher 10, connect the first side plate 130 to the second side plate 132 in such a manner that the second side plate 132 is spaced a distance from the first side plate 130 and is generally parallel thereto.

The lid 14 has a forward section 138, upon which the upper jaw 18 is constructed, and a rear section 140 which is pivotally connected to the base 12 and which, as will be discussed more fully below, is pivotally connected to the toggle linkage 22 so that movement of the toggle linkage 22 within the base 12 can be utilized to alternatively place the upper jaw 18 in the open position and in the closed position.

The upper jaw 18 is constructed similarly to the lower jaw 16. Portions of FIG. 1 have been cut away to show this construction and FIG. 2 further illustrates the interior construction of the upper jaw 18. As more particularly seen in FIG. 2, the upper jaw 18 includes a crusher plate 142 which is welded to the lower edges 144 of the side plates 130, 132. The crusher plate extends from the forward end 26 of the car crusher 10, toward the rear end 28 thereof and terminates near the center of the lid 14 so that, when the lid 14 is mounted on the base 12, in a manner to be described below, the crusher plate 142 substantially overlays the platform 82. A plurality of braces 145, similar in placement and construction to the braces 88 in the lower jaw 16, are incorporated into the upper jaw 18 to contribute to the structural rigidity thereof. The braces 145 are welded to the upper surface 146 of the crusher plate 142 and to the side plates 130, 132, extending therebetween to strengthen the upper jaw 18.

As more clearly shown in FIG. 1, the crusher plate 142 extends away from the first side plate 130 on the first side 34 of the car crusher 10 so that the upper jaw 18 includes a first lid sidewing 148 on the first side 34 in the same manner that the lower jaw 16 includes the first base sidewing 92 on the first side 34. A second lid sidewing (not shown), which mirrors the first lid sidewing 148 both in location and construction, is similarly formed on the second side plate 132. Since the second lid sidewing (not shown) is the mirror image of the first lid sidewing 148, it will not be necessary for purposes of this disclosure to describe both lid sidewings. Rather, the construction of the first lid sidewing 148 will be described and it will be understood that the second lid sidewing (not shown) is constructed in the same manner.

The first lid sidewing 148 includes an angle member 150 which is welded to the outer edge 152 of the crusher plate 142, extending along the length thereof. A first web 154 of the angle member 150 forms a sideward extension of the crusher plate 142, the lower surface 156 of the web 154 being flush with the lower surface 158 of the crusher plate 142, and the second web 160 extends upwardly from an outer wall for the first upper sidewing 148. An upperside plate 162 is welded to the distal edge of the second web 160 and extends therefrom to the first side plate 130 so that the first lid sidewing 148 is a tubular structure having walls formed by the first side plate 130, the crusher plate 142, the second web 160 of the angle member 150, and the upperside plate 162. The first lid sidewing 148 is strengthened by a plurality of internal gussets 164 disposed transversely to the tubular structure of the first lid sidewing 148 and welded to the first side plate 130, the crusher plate 142 and the second web 160. One member (not shown) of the plurality of gussets 164 closes the first upper sidewing 148 at the forward end 26 of the car crusher 10 and a cover plate 166 closes the first upper sidewing 148 near the center of the lid 14.

The crushing of an automobile is carried out by placing the automobile on the platform 82, while the lid is in the open position, and then bringing the crusher plate 142 down upon the automobile. In order to determine and retain the position of the automobile upon the platform 82, a plurality of retainers 167 are provided on the lower jaw 16. The retainers 167 are prismatically shaped structures, formed of steel plate, welded to the upper surface 102 of the platform 82 and disposed in predetermined positions on the lower jaw 16 as required.

During the crushing process, portions of the automobile have a tendency to buckle outward. In order to confine these portions, the upper jaw 18 is provided with a plurality of teeth 168 which are welded to the second web 160 of the angle members 150 on the first lid sidewing 148. An identical set of teeth (not shown) are welded to the second lid sidewing (not shown). The teeth 168 pass through alots 169 in the first web 154 and extend toward the lower jaw 16 when the lid 14 is in the closed position, the teeth 168 being generally disposed in near proximity to, and generally about the side perimiter of, the lower jaw 16 in the closed position of the lid 14. The teeth 168 extend beyond the platform 82 of the lower jaw 16 when the lid 14 is in the closed position and clearance slots 171 are formed in the first web 98 of the angle member 94 on the first base sidewing 92 and on the second base sidewing (not shown) to provide clearance for the teeth 168. Although two teeth 168, attached to the first lid sidewing 148, are illustrated in FIG. 1, it is clear that a greater or lesser number of teeth 168 could be employed in conjunction with each lid sidewing.

The teeth 168 comprise lengths of U-shaped channel beam 173 welded to the first lid sidewing 148 and the second lid sidewing (not shown) such that the "U" opens away from the lid 14. Each tooth further comprises a guide wing 175 welded to the channel beam 173 near the lower or scrap engaging end 177 thereof. The guide wing 175 is welded to the channel beam 173 within the interior of the "U" and to portions of the channel beam 173 which form the base of the "U". The guide wing 175 extends perpendicularly from such portions so the guide wing 175 is substantially parallel to the legs of the "U" and is partially enclosed therebetween. The scrap engaging end 177 of the channel beam 173 and the lower edge 179 of the guide wing 175 are arcuately curved to facilitate the confinement of buckled portions of an automobile by the teeth 168. As the automobile buckles outwardly from the region from between the jaws 16, 18, the arcuately curved portions of the guide wings 175 and channel beams 173 continuously engage the outwardly buckled portions of the automobile and guide such portions inwardly; that is toward the region between the jaws 16, 18.

The pivot 24, by means of which the lid 14 is mounted on the base 12, will now be described with particular reference to FIG. 3, which is a partial cross section of the car crusher 10 taken through the pivot 24. The pivot 24 generally comprises first and second base sleeve bearings, 170 and 172 respectively, mounted on the first and second sidewalls 40, 42 respectively of the base 12, first and second lid sleeve bearings **174, 174*a* mounted on the lid 14 and a pivot pin 176 which passes through the sleeve bearings 170, 172, 174 and 174*a* to pivotally connect the lid 14 to the base 12. In order to mount the first and second base sleeve bearings 170, 172 on the base 12, circular apertures 178 and 180 are formed in the side walls 40, 42, respectively, and in the vertical brace plates 114, 115 attached thereto, the apertures being positioned such that a line between the centers of the apertures 178, 180 is generally perpendicular to the sidewalls 40, 42. The diameters of the apertures 178, 180 are slightly larger than the outside diameters of the first and second base sleeve bearings 170, 172 to permit insertion of the base sleeve bearings 170, 172 through the apertures 178, 180 and to permit minor adjustment of the positions of the base sleeve bearings 170, 172 within the apertures 178, 180. The first base sleeve bearing 170 is provided with a mounting ring 182 by means of which the first base sleeve bearing 170 is attached to the base 12. The mounting ring 182 is an apertured, circular plate which is welded on the first base sleeve bearing 170 in such a manner that the mounting ring 182 is concentric with the base sleeve bearing 170, and the mounting ring 182 is welded to the first vertical brace plate 114 to attain the first base sleeve bearing 170 to the base 12. The second base sleeve bearing 172 is provided with an identical mounting ring 184 so that the second base sleeve bearing 172 may be attached to the base 12 by welding the mounting ring 184 to the second vertical brace plate 115. The base sleeve bearings 170, 172 are attached to the base 12 via the mounting rings 182, 184, rather than attached directly to the base 12, to permit the base sleeve bearings 170, 172 to be positioned into coaxial alignment, by adjustment of the positions of the base sleeve bearings 170, 172 within the apertures 178, 180, during the permanent installation of the sleeve bearings 170, 172 in the base 12**.

The lid sleeve bearings **174, 174*a* are mounted on the lid 14 in the same manner that the base sleeve bearings 170, 172 are mounted on the base 14. The lid sleeve bearings 174, 174*a* are provided with concentric mounting rings 186, 188, respectively. Apertures 190, 192, large enough to accept the lid sleeve bearings 174, 174*a* and to permit minor adjustment of the positions of the lid sleeve bearings 174, 174*a* therewithin are formed in the side plates 130 and 132 respectively. After adjusting the positions of the lid sleeve bearings 174, 174*a* to bring them into coaxial alignment, the mounting rings 186, 188 are welded to the side plates 130, 132, respectively, to permanently install the lid sleeve bearings 174, 174*a* on the lid 114**.

The lid 14 is assembled on the base 12 by aligning the sleeve bearings 170, 172, 174, and **174*a* and inserting the pivot pin 176 therethrough as shown in FIG. 3. Although it is clear that the pivot pin 176 may be inserted from either the first side 34 or the second side 36 of the car crusher 10, FIG. 3 has been drawn with the pivot pin 176 inserted from the first side 34 in order to illustrate the manner in which the pivot pin 176 is secured to the base 12 of the car crusher 10. A flange 194 is formed on one end 196 of the pivot pin 176 so that, when the pivot pin 176 is inserted through the bearing sleeves 170, 172, 174 and 174*a*, the flange 194 will engage the mounting ring 182 used to secure the first base sleeve bearing 170 to the base 12, thereby preventing further movement of the pivot pin 176 toward the second side 36 of the car crusher 10. The pivot pin 176 is secured in this position by a retaining strip 198 which is welded to the mounting ring 182 and which has an offset portion 200 which extends over the flange 194 to engage the end 196 of the pivot pin 176, thereby preventing movement of the pivot pin 176 toward the first side 34 of the car crusher 10**.

It will be clear to one skilled in the art that the rear section 140 of the lid 14 will experience the same large forces, arising from the weight of the lid 14 and from the operation of the car crusher 10, that the rear portions 80 of the sidewalls 40, 42 experience. As has been discussed, the rear portions 80 of the sidewalls 40, 42 were provided with external bracing to enable the base 12 to withstand these forces. Similarly, the rear portion 140 of the lid 14 is provided with internal bracing, shown in FIG. 2, which maintains the structural rigidity thereof. The internal bracing of the lid 14 includes a first brace member 202 which is welded to the lid sleeve bearings **174, 174*a* and slopes upwardly therefrom, generally toward the forward end 26 of the car crusher 10, the first brace member 202 terminating at the rear ceiling plate 134, to which the first brace member 202 is welded. The first brace member 202 extends across the lid 14, from the first side plate 130 to the second side plate 132, and is welded to the side plates 130, 132. Similary, a second brace member 204 is welded to the lid sleeve bearings 174, 175 and slopes upwardly therefrom generally toward the rear end 28 of the car crusher 10 terminating at the rear ceiling plate 134 to which the second brace member 204 is welded. The second brace member extends across the lid 14 from the first side plate 130 to the second side plate 132 and the second brace member 204 is welded to the side plates 130, 132**.

A third brace member 209 extends between the first brace member 202 and the second brace member 204 and extends between the side plates 130, 132 and is disposed substantially parallel to the rear ceiling plate 134. The third brace member 209 is welded to the first brace member 202, the second brace member 204, the first side plate 130, and the second side plate 132. A plurality of braces 205, similar in construction to the braces 145 in the upper jaw 18, and an end brace plate 207 are welded to the side plates 130 and 132, extending therebetween, and welded to the rear ceiling plate 134.

A fourth brace member 211 extends between the second brace member 204 and the end plate 207 and between the side plates 130, 132, the fourth brace member 211 disposed substantially parallel to the rear ceiling plate 134. The fourth brace member 211 is welded to the second brace member 204, the end plate 207, and the side plates 130, 132 to complete the internal bracing of the lid 14.

The lid 14 of the car crusher 10 is alternatively positionable in the open position and in the closed position by the toggle linkage 22 which will not be generally described with particular reference to FIG. 2. The toggle linkage 22 comprises a reciprocating member 220, also referred to herein as a trolley, which is moved alternatively toward the forward end 26 and the rear end 28 of the car crusher 10 by a hydraulic ram 222. The toggle linkage 22 further comprises a lever arm 224 which is attached via a pivot 226 to the trolley 220 and is attached via a pivot 228 to the rear portion 140 of the lid 14.

The trolley 220 is constrained, by means which will be discussed below, to move substantially parallel to the floor plate 44, so that, when the trolley 220 is moved in a first direction 221, toward the forward end 26 of the car crusher 10, the lever arm 224 pulls portions of the rear section 140 of the lid 14 into the channel 46; consequently, the lid 14 is turned about the pivot 24 and is moved to the open position. Movement of the trolley 220 in a second direction 223, toward the rear end 28 of the car crusher 10, pushes the rear section 140 of the lid 14 out of the channel 46, via a pivotation of the lever arm 224, so that the lid is rotated about pivot 24 to the closed position.

The hydraulic ram 222 comprises a hydraulic cylinder 230 which is attached to the base 12 and a piston rod 232 which is attached to the trolley 220. To provide means of attaching the cylinder 230 to the base 12, the base 12 is provided with a pair of apertured ears 234 (only one ear is shown in FIG. 2) which are welded to the platform 82 and to selected braces 88, the ears 234 extending into the channel 46. The cylinder 230 has a flat, apertured extension 236 which fits between the ears 234 and is secured thereto by a pin 238 which passes through the apertures in the ears 234 and in the extension 236. Dislodgement of the pin 238 is prevented in the same manner that dislodgement of the pin 176 in the pivot 24 is prevented; that is, one end of the pin 238 is provided with a flange (not shown) and a retaining strip (not shown), having an offset portion which engages the flanged end of the pin, is welded to the ear which engages the flange.

The trolley 220 is constrained to move parallel to the floor plate 44 by a guideway 239 comprising a plurality of rails which are parallel to the floor plate 44 and which extend from the rear end 28 of the car crusher 10 toward the forward end 26 thereof. Two rails are associated with each sidewall 40, 42 of the base 12 and the rails associated with the second sidewall 42 are illustrated in FIG. 2. These comprise an upper rail 240 which is attached to the second sidewall 42 and a lower rail 242 which is attached to the floor plate 44 and extends into the channel 46 immediately below and spaced a predetermined distance from the upper rail 240.

The lower rail 242 is conveniently fabricated of a length of I-beam such as that commonly used in railroad tracks. The construction of the upper rail 240 is shown in FIG. 1, and as shown therein, the upper rail 240 comprises a length of steel bar 244 spaced a short distance from the second sidewall 42 by a length of channel beam 246. The upper rail 242 is conveniently mounted on the second sidewall 42 by a plurality of bolts (not shown) which pass through apertures (not shown) in the steel bar 244, the channel beam 246, and the second sidewall 42.

Another upper rail (not shown) and another lower rail, designated 248 and visible in FIG. 1, are constructed in the same manner as the upper rail 240 and the lower rail 242, respectively, and are disposed along the first sidewall 40 in like manner to that of the second upper rail 240 and the second lower rail 242 so that the rails associated with the first sidewall 40 mirror the rails 240, 242 associated with the second sidewall 42.

The trolley 220, illustrated in FIGS. 4 and 5, comprises a plurality of wheels 250, a number of which are disposed between the upper rail (not shown) and the lower rail 248 (along the first sidewall 40), and a number of which are disposed between the upper rail 240 and the lower rail 242 (along the second sidewall 42) when the trolley 220 is disposed within the channel 46 of the base 12. The wheels 250 roll along the guideway 239 when the trolley 220 is moved back and forth within the channel 46 by the hydraulic ram 222 so that the trolley 220 is constrained to undergo longitudinal motion parallel to the floor plate 44. Although four wheels 250 are illustrated in FIG. 4, it will be clear that a different number of wheels could be utilized with the trolley 220.

As shown in FIG. 4, which is a top plan view of the trolley 220, and in FIG. 5, which is an elevational view of one end of the trolley 220, the trolley 220 comprises a box 252, fabricated from steel plate, that is adapted to provide for the attachment thereto of the wheels 250, the piston rod 232, and the lever arm 224. The box 252 has a forward end 254, a rear end 256, an upper side 258, an under side 260, a first side 262, and a second side 264, which, when the trolley 220 is disposed within the channel 46 in the base 12, are aligned according to the alignment of the correspondingly named sides and ends of the car crusher 10.

In order to provide for the attachment of the piston 232 and the lever arm 224, a groove 268 is formed in the central portions of the upper side 258 of the box 220, the groove extending from the forward end 254 to the rear end 256 of the box 252. A yoke 270, comprising a first side member 272, a second side member 274, and a floor member 276, is welded into the groove 268 with the side members 272 and 274 extending above the upper side 258 of the box 252. The piston rod 232 is provided with an ear 278 which fits between the side members 272 and 274 of the yoke 270 when the car crusher 10 is assembled. The side members 272 and 274 and the ear 278 have apertures (not shown) which accept a pin 280 to secure the piston rod 232 to the yoke 270. One end of the pin 280 has a flange 282 which prevents the pin from passing through the apertures in the yoke 270 and the ear 278. A retaining strip 284 is welded to the side member 272 to engage the flange 282 as shown in FIG. 4 to prevent dislodgement of the pin 280.

Similarly, the lever arm 224 has an apertured pivot plate 286 which fits between the side members 272 and 274 of the yoke 270, and apertures (not shown) are formed in these members to permit a flanged pin 288 to secure the lever arm 224 to the yoke 270 in the same manner that the piston rod 232 is secured thereto so that portions of the pivot plate 286, portions of the side members 272, 274 and the pin 288 form the pivot 226. A retaining strip 290 secures the pin 288 to the yoke 270.

The trolley 220 further comprises a front axle 310 and a rear axle 312 to which the wheels 250 are attached. The axles 310 and 312 are mounted on lugs which are formed by extending the plates that form the sides of the box 252 beyond the forward and rear ends 254 and 256 of the box. The lugs are identical and each lug is provided with an identical bearing for the axles 310 and 312 so that it will not be necessary for purposes of this disclosure to describe each of the lugs and bearings on the trolley 220. Rather, the lugs have each been given the numerical designation 314 in FIGS. 4 and 5, and the bearings have each been given the numerical designation 316. It is noted that the description of the lug 314 and the bearing 316 given below applies to each such lug 314 and each such bearing 316. Similarly, where a portion of the lug 314 or a bearing 316 is referred to, a single numerical designation will be used to indicate the portion of each lug 314 and each bearing 316.

To provide for passage of the axles 310, 312 through the lugs 314 so that the wheels 250 may be disposed to either side of the box 252, the lugs 314 are provided with circular apertures 318 through which the axles 310, 312 pass. The bearings 316, which support the axles 310, 312, are attached to the inner surfaces 320 of the lugs 314 in substantially concentric alignment with the apertures 318. Each bearing 316 comprises a bearing sleeve 322, having a bore 324 which engages the axle 310, 312, and a ring-shaped mounting plate 326 attached to the sleeve 322 concentrically with the bore 324. The bearings 316 are attached to the lugs 314 by welding the mounting plate 326 thereto.

The wheels 250 are secured to the axles 310, 312 by retaining plates 327 which are welded to the ends of the axles 310, 312 after the wheels 250 have been mounted thereon.

The lever arm 224 which connects the trolley 220 to the lid 14 is shown in FIGS. 6 and 7, the latter figure also illustrating portions of the lid 14 to show the manner in which the lever arm 224 is connected to the lid 14. The lever arm 224 comprises: a lid member 328, which is pivotally connected to the lid 14; an arm member 330, having an upper portion 332, pivotally connected to the lid member 328; and a lower portion 334, to which the above mentioned pivot plate 286 is attached. The pivot plate 286 provides the means of connecting the lever arm 224 to the trolley 220.

The arm member 330 is constructed of steel plate and comprises a first slat 336 and a second slat 338 held in a parallel, spaced-apart relation by a plurality of braces 340 which are welded to both slats 336, 338. The pivot plate 286 extends across the space between the slats 336, 338, to which the pivot plate 286 is welded, and projects beyond the lower end 342 of the arm member 330 for attachment to the trolley 220.

The lid member 328 of the lever arm 224 comprises a cylindrical sleeve 344, which provides a means for connecting the lid member 328 to the lid 14, and a pair of arm connection plates 346, 348 which provide a means of connecting the lid member 328 to the arm member 330. The arm connection plates, 346, 248, are welded to the sleeve 344 and project therefrom in a parallel, spaced-apart alignment along tangents to the periphery of the sleeve 344. Braces 350 extend across the space between the arm connection plates 346 and 348 and are welded thereto to form the lid member 328 into a rigid structure capable of transmitting the force necessary to move the upper jaw 18 against the resistance of an automobile to crushing.

The spacing between the arm connection plates 346, 348 is smaller than the spacing between the slats 336, 338 so that, in the assembled lever arm 224, the arm connection plates 346, 348 are disposed between the slats 336, 338. The arm connection plates 346, 348 and the slats 336, 338 are provided with apertures (only one aperture 352 in the arm connection plate 346 is shown) which are aligned in the assembled lever arm 224. The lid member 328 of the lever arm 224 is attached to the arm member 330 by passing a pin 354 through the apertures. The pin 354 is retained in the lever arm 224 in the same manner that the pins 280 and 288 are retained in the trolley yoke 270; that is, the pin 354 has a flange 356 and a retaining strip 358 is welded to the slat 338 which engages the flange 356 such that the retaining strip 358 engages the pin 354 to prevent dislodgement thereof.

The sleeve 344 forms a portion of the pivot 228 by means of which the lever arm 224 is connected to the lid 14 as shown in FIG. 7. The pivot 228 further comprises: first and second sleeve bearings 362, 364 which are mounted respectively on the first and second side plates 130, 132 of the lid 14; and a pivot pin 366 which passes through the sleeves 344 and the bearings 362, 364 to connect the lever arm 224 to the lid 14. In order to mount the sleeve bearings 362, 364 on the lid 14, circular apertures 368, 370 are located near the rear end 28 of the car crusher 10 and are aligned such that a line between the centers of the apertures 368, 370 is generally perpendicular to the side plates 130, 132. The diameters of the apertures 368, 370 are slightly larger than the diameters of the sleeve bearings 362, 364 to permit insertion of the sleeve bearings 362, 364 through the apertures 368, 370 and to permit minor adjustment of the positions of the sleeve bearings 362, 364 in the apertures 368, 370. The sleeve bearings 362, 364 are provided with mounting rings 374, 376 which are welded to the sleeve bearings 362, 364 such that the mounting rings 374, 376 are concentric with the sleeve bearings 362, 364. The sleeve bearings 362, 364 are attached to the lid 14 by inserting the sleeve bearings 362, 364 through the apertures 368, 370, respectively, clamping the sleeve bearings 362, 364 into coaxial alignment, and welding the mounting rings 374, 376 to the side plates 130, 132.

The pivot pin 366, which connects the lever arm 224 to the lid 14, may be inserted through the sleeves 344 and the bearings 362, 364 from either the first side 34 or the second side 36 of the car crusher 10. By way of example, the pivot pin 366 is shown in FIG. 7 as having been inserted from the first side 34. The pivot pin 366 has a flange 378 which, when the pivot pin 366 is inserted from the first side 34, engages the first mounting ring 374. A retaining strip 380, welded to the first mounting ring 374 after insertion of the pivot pin 366, engages a portion of the flange 378 as shown in FIG. 7 to prevent dislodgement of the pivot pin 366.

OPERATION OF THE CAR CRUSHER

Figure 8:
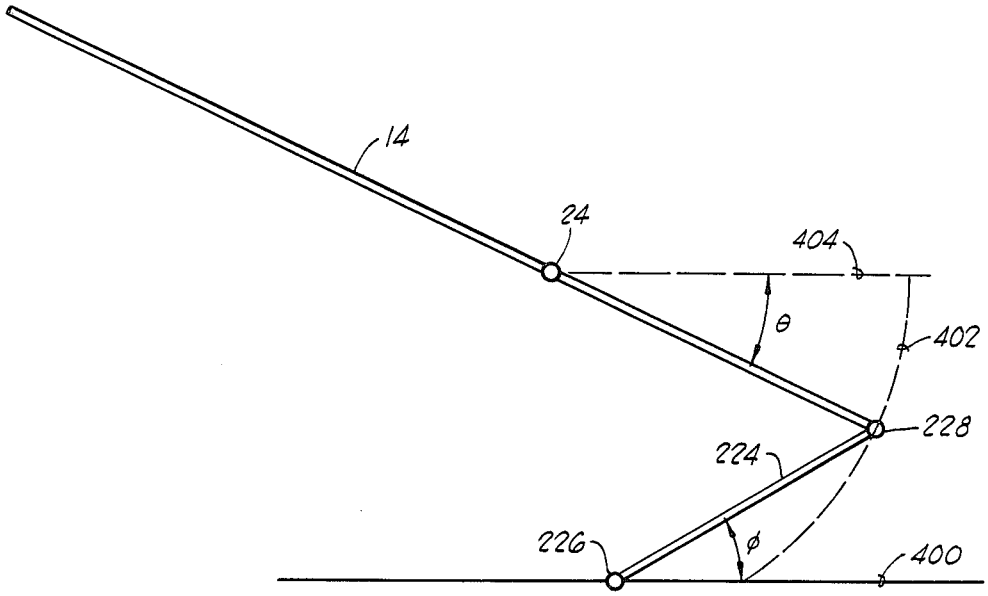
FIG. 8 is a diagrammatical representation of a compacting apparatus constructed in accordance with the present invention, shown in side elevational view.

Although the movements of the major elements of the car crusher 10 during operation thereof have been described in the foregoing description of the construction of the car crusher 10, a more complete understanding of the present invention may be had by considering the operation with respect to a simplified drawing. FIG. 8 has been included to provide a visual reference for discussion of the variation of mechanical advantage of the car crusher 10 with the degree of compaction of an object being crushed.

In FIG. 8, the lid 14 and the lever arm 224 have been represented as a pair of beams, labelled with the numerical designations of the elements of the car crusher 10 they represent. Also shown are representations of the pivots 24, 228, and 226 which connect the lid 14 to the base 12, the lever arm 224 to the lid 14, and the trolley 220 to the lever arm 224 respectively. For clarity, the portions of FIG. 8 which represent an element of the car crusher 10 will be referred to in the following discussion by the name of the element represented.

It will be clear from the discussion of the construction of the car crusher 10 that the pivot 226, connecting the lever arm 224 to the trolley 220, will move along a line parallel to the floor plate 44 of the car crusher 10 as the trolley 220 is moved back and forth within the channel 46. This line of action of the pivot 226 has been given the numerical designation 400 in FIG. 8. Similarly, the pivot 228, connecting the lever arm 224 to the lid 14 will move along a circular arc 402 in FIG. 8, as the lid 14 is moved between the open and close positions.

The angular disposition of the lid 14 during the operation of the car crusher 10 can be conveniently represented by specifying the angle ($\theta$), shown in FIG. 8, between a line connecting the pivots 24 and 228 and a reference line such as line 404. Similarly, the angular disposition of the lever arm 224 can be represented by specifying the angle ($\phi$) between the lever arm 224 and the line of action 400 of the pivot 226. It will be recognized that the angles ($\theta$) and ($\phi$) are not unrelated; indeed, as will be discussed more fully below, the relationship between the angles ($\theta$) and ($\phi$) may be varied to adjust the relationship between the mechanical advantage provided the car crusher 10 by the lever arm 224 of the toggle linkage 22 and the angular disposition of the lid 14.

A convenient measure of the mechanical advantage provided the car crusher 10 by the toggle linkage 22 is the ideal mechanical advantage provided by the lever arm 224 treated as a machine which exerts a force on the pivot 228, connecting the lid 14 to the lever arm 224, when a force is exerted on the pivot 226, connecting the lever arm 224 to the trolley 220. As used herein, the term ideal mechanical advantage means the ratio of an increment of distance traversed by the pivot 226 to a corresponding increment of distance traversed by the pivot 228. When the ideal mechanical advantage is less than 1, the pivot 228 moves more rapidly along the arc 402 than the pivot 226 moves along the line of action 400 to move the lid 14 rapidly. The price paid for this rapid movement of the lid 14 is a corresponding decrease in the ratio of the force which pushes the pivot 228 along the arc 402 to the force which pushes the pivot 226 along the line of action 400. Conversely, when the ideal mechanical advantage is greater than 1, the pivot 228 moves more slowly than the pivot 226 so that the lid 14 moves slowly but the force which moves the pivot 228 along the arc 402 is correspondingly greater than the force which moves the pivot 226 along the line of action 400.

The ideal mechanical advantage of the lever arm 224, considered as a machine, is easily determined in terms of the angles ($\theta$) and ($\phi$) by considering a small decrease in th angle ($\theta$) and calculating the resulting distances the pivot 226 and 228 move along the line of action 400 and along the arc 402 respectively. The ratio of the first of these distances to the second of these distances is the ideal mechanical advantage. The ideal mechanical advantage calculated in this manner is:

$$\text{Ideal Mechanical advantage} = [\sin\theta + (\cos\phi)(\tan\phi)].$$

It will be clear from FIG. 8 that the angle ($\phi$) increases as the angle ($\theta$) decreases; that is, as the lid 14 approaches the closed position, the angle between the lever arm 224 and the line of action 400 of the pivot 226 increases. As a result, the first term in the expression for the ideal mechanical advantage decreases as the lid 14 approaches the closed position and the second term increases. By proper choice of the distance between the pivots 24 and 228, the distance between the pivots 226 and 228, and the distance between the pivot 24 and the line of action 400 of the pivot 226, the rate at which the second term increases may be made to exceed the rate at which the first term decreases so that the ideal mechanical advantage increases as the lid 14 nears the closed position. Moreover, by changing the relative sizes of these distances, the dependence of the ideal mechanical advantage on the angle ($\theta$) can be tailored to the job at hand. It is clear that the relative sizes of these distances is easily changed by, for example, choosing different lengths of the lever arm 224 for different jobs.

The relationship between the angles ($\theta$) and ($\phi$) can be expressed in terms of the distance between the pivots 24 and 228, herein denoted R, the distance between the pivots 226 and 228, herein denoted L, and the distance between the pivot 24 and the line of action 400, herein denoted H. For values of the angle ($\theta$) such that the pivot 228 is above the line of action 400, this expression is:

$$H = [(R)(\sin\theta) + (L)(\sin\phi)].$$

Figure 9:
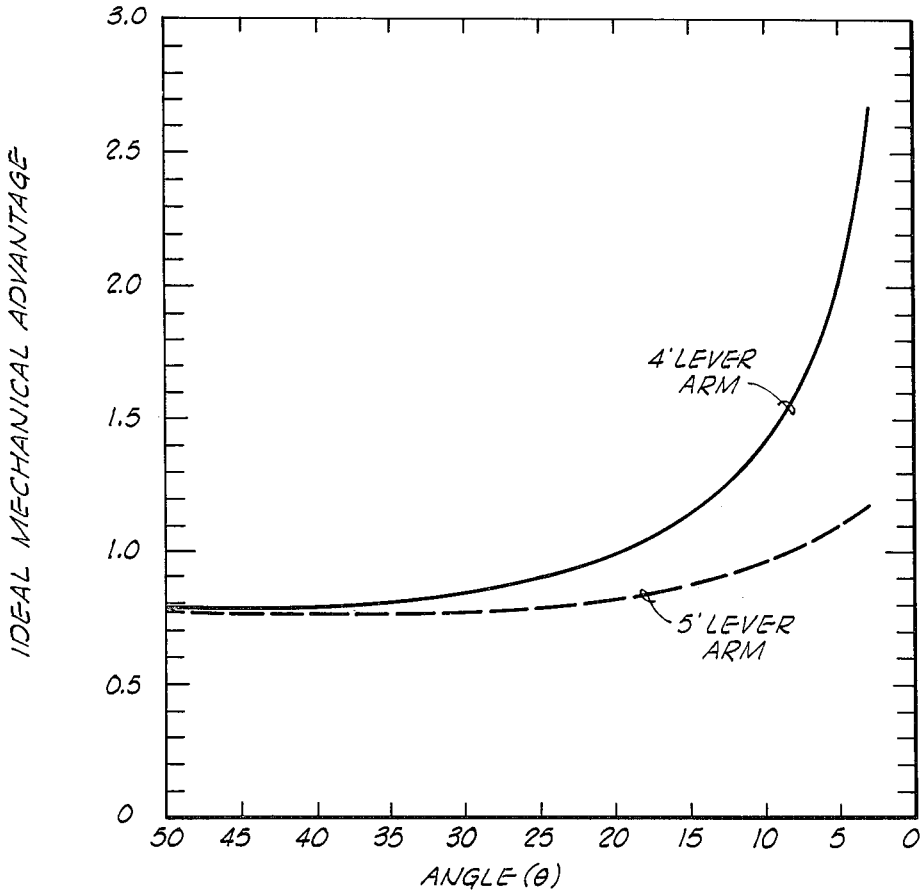
FIG. 9 is a graph of the ideal mechanical advantage provided by the toggle linkage for two choices of length of the lever arm thereof.

In one embodiment of the present invention, the distances R, H and L have been chosen to tailor the car crusher 10 to the task of crushing automobiles for salvage. In such an application, it is desirable that the mechanical advantage remain low over a considerable range of positions of the lid 14, so that the lid will move rapidly over the major portion of its range, and then increases rapidly as the lid 14 nears the closed position. In this embodiment, the values of R, H and L are 5 feet, 4 feet and 4 feet respectively. The resulting variation of the ideal mechanical advantage for these distances has been presented graphically in FIG. 9 where the solid curve in FIG. 9 is the ideal mechanical advantage, plotted on the ordinate versus the angle ($\theta$) plotted on the abscissa. For comparison purposes, the dashed line in FIG. 9 shows the mechanical advantage variation when the length L, of the lever 224 arm is increased to five feet to tailor the car crusher 10 to a job in which a gradual increase in the mechanical advantage over the entire range of movement of the lid 14 is more desirable than a rapid increase thereof as the lid 14 nears the closed position.

It is evident that the presently described invention provides a compacting apparatus that incorporates a variable mechanical advantage that is useful in the crushing of scrap automobiles and other scrap metal objects. Also, it is evident that the other objects, advantages and features described hereinabove are fully met by the described invention. It will be recognized that changes may be made in the construction and arrangement of the parts or elements of the embodiment disclosed herein without departing from the spirit and the scope of the invention as defined in the following claims.

I claim:

1. An apparatus for compacting an object, comprising:

a base having a forward section and a rear section, the forward section forming a lower jaw;

a lid member having a forward section and a rear section, the forward section forming an upper jaw, the lid member pivotally connected to the base at a pivot disposed intermediate to the forward and rear sections of the lid member, the upper jaw substantially overlaying the lower jaw of the base and disposed a preselected distance therefrom in a closed position of the lid member, the upper jaw removed from the lower jaw of the base in an open position of the lid member;

a toggle linkage member having a first end and a second end, the first end pivotally connected to the rear section of the lid member; and means for moving the second end of the toggle linkage member alternatively in a first direction toward the lower jaw and in a second direction away from the lower jaw, the lid member moved toward the open position when the second end of the toggle linkage member is moved in the first direction, and the lid member moved toward the closed position when the second end of the toggle linkage member is moved in the first direction, wherein the means for moving the second end of the toggle linkage member is characterized as comprising:

a longitudinal guideway supported by the base;

a reciprocating member supported by the guideway, the reciprocating member movable along the guideway alternatively in the first direction and in the second direction, the second end of the toggle linkage member pivotally connected to the reciprocating member; and means for moving the reciprocating member in the first direction and in the second direction.

2. The apparatus of claim 1 wherein the guideway is characterized as comprising a plurality of rails extending longitudinally and supported by the base, and the reciprocating member is characterized as comprising a trolley member having a plurality of wheels rollingly engagable with the rails for guided movement of the trolley member.

3. The apparatus of claim 2 wherein the means for moving the reciprocating member comprises a hydraulic ram characterized as having a hydraulic cylinder connected to the base and an extendible piston rod supported by the hydraulic cylinder and connected to the trolley member.

4. The apparatus of claim 3 further comprising:

teeth means for confining the object to a region substantially between the upper and lower jaws as the lid member is moved toward the closed position.

5. The apparatus of claim 4 wherein the teeth means is characterized as comprising:

a plurality of teeth connected to the upper jaw, each of the teeth having a scrap engaging end and extending generally toward the lower jaw in the closed position of the lid member, the teeth disposed generally in near proximity to and generally about the side perimiter of the lower jaw in the closed position of the lid member; and a plurality of guidewings, one each of the guideways attached to the scrap engaging end of one of the teeth, the scrap engaging end and the guideway being arcuately shaped for guiding outwardly buckled portions of the object being compacted toward the region between the upper jaw and the lower jaw when the lid member is moved toward the closed position.

6. The apparatus of claim 5 wherein the base is further characterized as having its rear section forming a U-shaped channel, and the guideway and trolley members are disposed in the channel.

7. The apparatus of claim 6 further characterized as comprising a plurality of object retainer members supported by the lower jaw in predetermined positions on the lower jaw to determine and retain the position of the object on the lower jaw.

8. An apparatus for compacting an automobile comprising:

a base having a forward section and a rear section, the forward section forming a generally horizontally extending lower jaw and the rear section forming a U-shaped channel;

a lid member having a forward section and a rear section forming an upper jaw, the lid member pivotally connected to the base at a pivot disposed between the forward and rear sections of the lid member, the upper jaw substantially overlaying the lower jaw of the base a preselected distance therefrom in a closed position of the lid member, the upper jaw removed from the lower jaw in an open position of the lid member;

a toggle linkage member having one end pivotally connected to the rear section of the lid member;

a longitudinal guideway supported by the base in the channel and extending generally horizontally;

a reciprocating member supported by the guideway for movement alternatively in a first direction toward the lower jaw and in a second direction away from the lower jaw, the other end of the toggle linkage member pivotally connected to the reciprocating member; and means connected to the reciprocating member for moving the reciprocating member alternatively in the first direction whereby the lid member is moved to the open position, and in the second direction whereby the lid member is moved to the closed position.

9. The apparatus of claim 8 wherein the guideway comprises a plurality of rails supported by the base in the channel, and the reciprocating member comprises a trolley member having a plurality of wheels rollingly engagable with the rails.

10. The apparatus of claim 9 wherein the means for moving the reciprocating member comprises a hydraulic ram characterized as having a hydraulic cylinder connected to the base and an extendible piston rod supported by the hydraulic cylinder and connected to the trolley means.

11. The apparatus of claim 10 further comprising:

teeth means for confining the automobile to a region substantially between the upper and lower jaws as the lid member is moved to the closed position.

12. The apparatus of claim 11 wherein the teeth means is characterized as comprising:

a plurality of teeth connected to the upper jaw, each of the teeth having a scrap engaging end and extending generally toward the lower jaw in the closed position of the lid member, the teeth disposed generally in near proximity to and generally about the side perimiter of the lower jaw in the closed position of the lid member; and a plurality of guidewings, one each of the guideways attached to the scrap engaging end of one of the teeth, the scrap engaging end and the guideway being arcuately shaped for guiding outwardly buckled portions of the automobile being compacted toward the region between the upper jaw and the lower jaw when the lid member is moved toward the closed position.

13. The apparatus of claim 12 further comprising a plurality of retaining member supported by the lower jaw in predetermined positions of the lower jaw to determine and retain the position of the automobile on the lower jaw.

* * * * *